US009243417B2

(12) United States Patent
Diercks

(10) Patent No.: US 9,243,417 B2
(45) Date of Patent: Jan. 26, 2016

(54) PERSONAL SAFETY SYSTEM

(75) Inventor: Dietmar Diercks, Reinfeld (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 879 days.

(21) Appl. No.: 13/421,140

(22) Filed: Mar. 15, 2012

(65) Prior Publication Data

US 2012/0233923 A1 Sep. 20, 2012

(30) Foreign Application Priority Data

Mar. 16, 2011 (DE) ..... 10 2011 014 104

(51) Int. Cl.

| | |
|---|---|
| ***F24F 7/06*** | (2006.01) |
| ***B01L 1/04*** | (2006.01) |
| ***E04H 9/04*** | (2006.01) |
| ***E04H 9/16*** | (2006.01) |
| ***F24F 3/16*** | (2006.01) |
| ***F24F 9/00*** | (2006.01) |
| ***E04H 1/12*** | (2006.01) |
| *F24F 13/24* | (2006.01) |

(52) U.S. Cl.

CPC ..... *E04H 9/04* (2013.01); *E04H 1/1277* (2013.01); *E04H 9/16* (2013.01); *F24F 3/161* (2013.01); *F24F 7/06* (2013.01); *F24F 9/00* (2013.01); *F24F 13/24* (2013.01); *F24F 2009/005* (2013.01); *F24F 2221/44* (2013.01)

(58) Field of Classification Search

USPC ..... 454/228, 187

IPC ..... F24F 3/161,7/06, 9/00, 13/24, 2221/44, F24F 2009/005, 13/02, 13/0227, 13/0236; E04H 9/04, 9/16

See application file for complete search history.

(56) References Cited

U.S. PATENT DOCUMENTS

| | | | | |
|---|---|---|---|---|
| 5,890,367 | A * | 4/1999 | You et al. | 62/78 |
| 2008/0196329 | A1 | 8/2008 | Kennedy et al. | |
| 2008/0311842 | A1 * | 12/2008 | Alston et al. | 454/361 |

FOREIGN PATENT DOCUMENTS

| | | | |
|---|---|---|---|
| DE | 35 21 884 | C1 | 10/1986 |
| DE | 39 25 941 | A1 | 2/1991 |
| DE | 39 27 673 | A1 | 2/1991 |
| JP | 2004 085147 | A | 3/2004 |

* cited by examiner

*Primary Examiner* — Steven B McAllister
*Assistant Examiner* — Helena Kosanovic
(74) *Attorney, Agent, or Firm* — McGlew and Tuttle, P.C.

(57) ABSTRACT

A personal safety system with a security entrance (4), a holding room (5) connected to security entrance (4), an air curtain device (2) at an entrance door (3) of the security entrance (4), allows a persons to reach the holding room in a short time. To accomplish the object a circulating air system (13, 15, 18, 19, 20, 22, 25, 26) is provided for the interior space enclosed by the security entrance (4) and for the holding room (5). The circulating air system (13, 15, 18, 19, 20, 22, 25, 26) includes at least one air delivery unit (18) and a toxic gas filter (19), an air flushing device (28, 30, 31) with air storage units (29) for the holding room (5) and a gas supply duct (27) in the holding room (5) for respirator products.

18 Claims, 3 Drawing Sheets

PERSONAL SAFETY SYSTEM

CROSS REFERENCE TO RELATED APPLICATIONS

This application claims the benefit of priority under 35 U.S.C. §119 of German Patent Application DE 10 2011 014 104.9 filed Mar. 16, 2011, the entire contents of which are incorporated herein by reference.

FIELD OF THE INVENTION

The present invention pertains to a personal safety system with a security entrance and a holding room.

BACKGROUND OF THE INVENTION

A personal safety system with a security entrance and with a holding room is known from DE 35 21 884 C1. The prior-art personal safety system also comprises a ventilation and air exhaust system including a filter unit.

Prior-art personal safety systems are designed such that persons who enter the security entrance must stay therein until possible contaminations have been reduced to a permissible level. An air delivery unit, which flushes the security entrance and sends the gas over a toxic gas filter, is provided for decontamination. The degree of contamination can be determined by measuring the toxic gas concentration in the security entrance. The interior space may be entered only when the contaminations have been reduced to a permissible level. The security entrance must be as small as possible for fast decontamination, which means that only a small number of persons can stay in the security entrance. This security principle is not suitable for the case of a disaster with highly toxic gases, because persons who want to enter the security entrance wear an escape hood, which offers protection for a very limited time only. This means that persons cannot wait for entry at the outer door of the system because of time limitations. The duration of use of an escape hood is often limited to a period of 30 minutes. A fairly large number of persons can be expected to want to enter the holding room at the same time in case of a disaster.

SUMMARY OF THE INVENTION

A basic object of the present invention is to improve a personal safety system such that persons can reach the holding room in a short time.

According to the invention, a personal safety system is provided with a security entrance and a holding room connected to the security entrance. An air curtain device is provided at an entrance door of the security entrance. A circulating air system for the interior space enclosed by security entrance and for the holding room comprises at least one air delivery unit and a toxic gas filter. An air flushing device comprising air storage units is provided for the holding room. A gas supply duct is provided for respirator products.

The air curtain device may comprise an air feed duct, an air return duct and a blower.

The circulating air system may comprise another air feed duct, another air return duct, another blower and the toxic gas filter. The circulating air system for the holding room may also comprise a further air feed duct, a further air return duct as well as a further blower with another toxic gas filter. The circulating air system may be in common for the security entrance space and the holding room and may include the another air feed duct and the another air return duct in the security entrance space and the another blower with the toxic gas filter between the another air return duct and the another air feed duct. A reversing valve may be provided on the discharge side of the another blower. The reversing valve establishes a gas path to the another feed duct in a first switching position and establishes a gas path to the further air feed duct in the holding room in a second switching position. The air storage units of the air flushing device may be connected to the further air feed duct in the holding room. The air flushing device and/or circulating air system may be designed for a flushing flow rate of at least 600 $m^3$/hr.

The personal safety system according to the present invention has, in front of the entrance door of the security entrance, an air curtain device, which reduces the amount of toxic substances introduced during entry into the security entrance. The contaminations introduced by a person are reduced in the security area to a calculated level during the passage over the high-performance filter device. Persons enter the holding room without delay and must keep the respirator on there only as long as introduced contaminations are indicated. Breathing masks, which can be supplied from autarchic breathing air storage units for a long period of time, may be put on when needed.

When all persons have entered the room, the holding room is flushed with breathing air at a high air exchange rate. The toxic substance concentrations are reduced after a few minutes to a permissible level, and the breathing masks can be removed. The room air is monitored by means of a gas-measuring device, and optical and acoustic warnings are triggered when impermissible values are exceeded. Not only is the room air purified now by means of a circulating air system and a toxic gas filter, but fresh breathing air is introduced at the same time into the interior space of the holding room by means of an air flushing means to support flushing by the circulating air system.

The breathing masks, which are being worn by the persons in the holding room, are also supplied with breathing air during the air flushing.

The air curtain unit arranged in front of the entrance door of the security entrance is provided with a closed air shield. This markedly reduces the thermal effect during the opening of the entrance door, which effect is brought about by different temperatures. Slight wind effects are reduced and decelerated by the invisible air curtain. The amount of toxic substances introduced into the security entrance is greatly reduced thereby. Toxic substances are introduced when opening the entrance door by thermal effects and by contaminations being carried in by persons.

The quantity of contaminants carried in by the persons per unit of time can be determined by limit value considerations. It is assumed that each person introduces a quantity of air corresponding to his body volume into the security entrance. If thermal effects are eliminated by the air curtain device, it can be assumed that only contaminations in the security entrance must be removed.

Example: 100 persons (P) shall enter in 10 minutes. Assumptions: 80 L of body volume per person, 5,000 ppm outside contamination, corresponding to 0.5 vol. %.

Quantity of contaminated air carried in:

$$100\ P \times 80\ L/10\ \text{minutes} = 800\ L\ \text{per minute}.$$

Quantity of toxic gas carried in:

$$100\ P \times 80\ L/10\ \text{minutes} = 800\ L\ \text{per minute} * 0.5\% = 4\ L/\text{minute}.$$

The filter unit will be designed such that the toxic gas concentration in the security entrance is limited to a predetermined value.

Example: In case of introduction of toxic gas at a rate of 4 L/minute, the toxic gas concentration in the security entrance shall be limited to 0.04%, corresponding to 400 ppm. The filter efficiency equals 90%.

The necessary air throughput of the filter equals 4 L/minute/0.04%*0.9=667 $m^3$/hr.

When a concentration of 400 ppm is reached in the security entrance, the filter unit removes 4 L/minute of toxic gas from the air. This corresponds to the hypothetical quantity of toxic gas introduced. The filter capacity is selected to be higher for the actual design of the unit.

Based on the same calculation example, a reduced quantity of toxic substances is introduced into the holding room, because each person carries in only a quantity of toxic substance corresponding to 400 ppm rather than 5,000 ppm.

The volume of the quantity of toxic gas carried in equals:

Toxic gas carried in:

100 P×80 L/10 minutes=800 L per minute*0.04%=0.32 L/minute.

Concentration in the room air after all persons have entered:

0.32 L/minute*10 minutes=3.2 L.

Concentration in the room air in the holding room after all persons have entered:

Room size: 111 $m^3$

Concentration in the room air: 3.2/111,000=28 ppm

The permissible concentration in the room air equals 5 ppm.

Consequently, all persons must still be supplied with breathing gas with masks via a central breathing unit over a certain transition time.

The following purification functions can be used for purification to the permissible value of 5 ppm:

Filtration over the CO2 absorber: Purification capacity 600 $m^3$/hr.

Circulating air filtration via the gas filter unit, which is optionally provided for each room, or as a central, switchable filter unit.

Air flushing with breathing air from the storage cylinders.

The following quantity of air is needed to purify 28 ppm toxic gas (a) to 5 ppm (b):

In (ppm (a)/ppm (b))*room volume=ln 28/5*111=191.2 $m^3$ and for a filter efficiency of 80%, 239 $m^3$; with ln=natural logarithm.

Time for purification in the holding room.

a) Purification by means of air flushing from air storage units: 17 cylinders@14,000 L useful volume are needed. If the quantity of flushing air is 600 $m^3$/hr., the purification time is approximately 24 minutes.

b) Purification by means of the gas filter unit: About the same time is needed with the rated volume flow of 667 $m^3$/hr.

c) Purification by means of the absorber lime cartridges: About the same time is needed with the nominal volume flow rate of 600 $m^3$/hr.

The time can be reduced considerably in case of cooperation of all action mechanisms, namely, air flushing, filtration and the use of absorber. Air flushing and gas filtration can be used together simultaneously in every case, and the time for purifying the holding room would equal approximately 12 minutes.

The breathing unit is designed on the basis of this time as the minimum time. The actual breathing air capacity is designed to be such that the higher toxic gas concentrations can be purified in the safety room in case retention systems are inoperable and the corresponding air is available to the persons for supplying the masks during the longer purification time.

One exemplary embodiment of the device according to the present invention is shown in the figure and will be explained in more detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
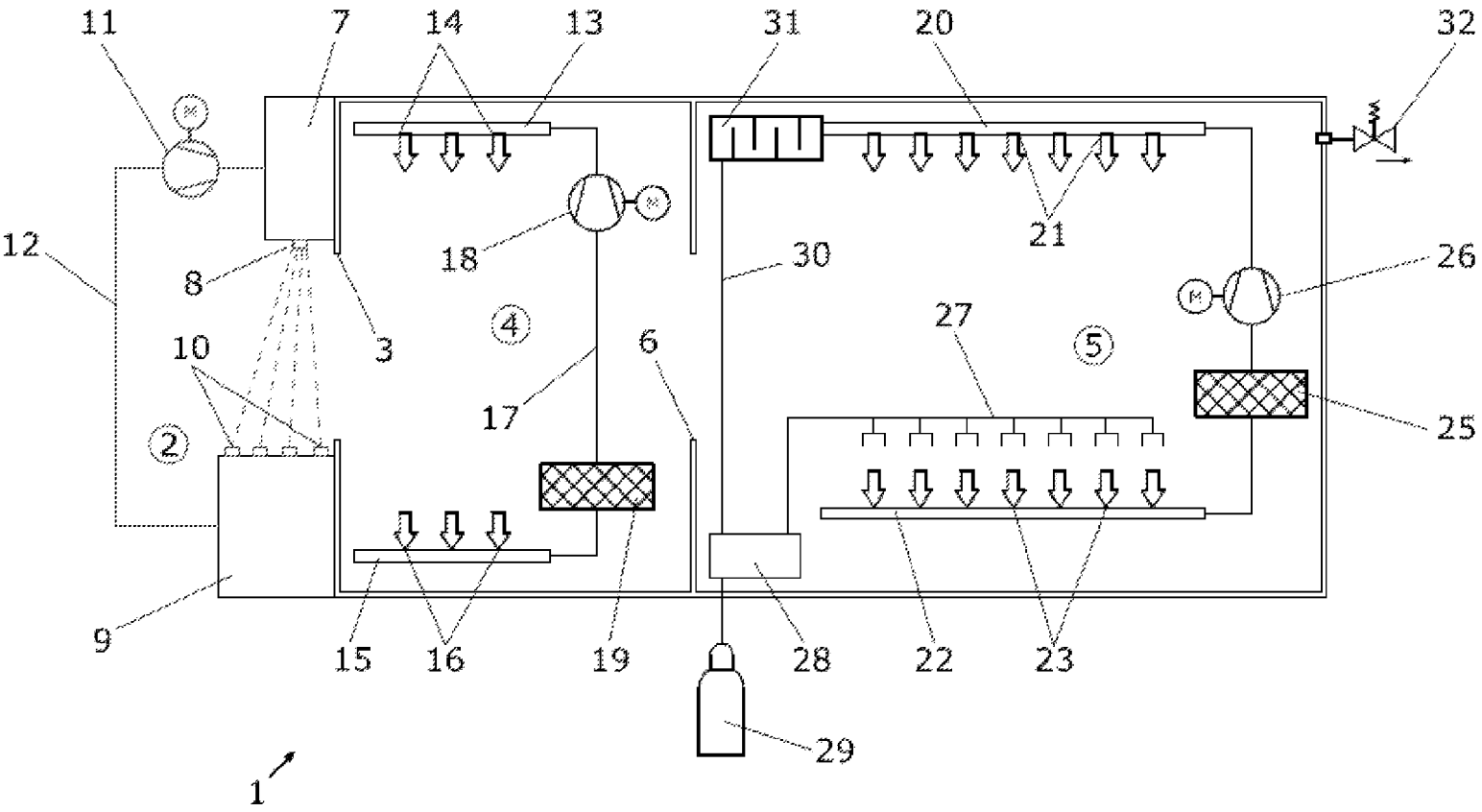
FIG. 1 is a pneumatic circuit diagram of a personal safety system.

Referring to the drawings in particular, FIG. 1 schematically illustrates the design of a personal safety system 1, which has an air curtain device 2 in front of an entrance door 3 to a security entrance (space) 4 and a holding room 5 connected to security entrance 4. A passage door 6 is located between security entrance 4 and holding room 5. The air curtain device 2 comprises a first air feed duct 7 with a discharge opening 8, a first air return duct 9 with air return openings 10 and a first blower 11. Blower 11 is connected via a first gas duct 12 to the first air feed duct 7 and to the first air return duct 9 and delivers ambient air from the first air return duct 9 to the first air feed duct 7. Air curtain device 2 may also be designed with an open design without air return duct.

A second air feed duct 13 with discharge openings 14, a second air return duct 15 with inlet openings 16, which are connected to one another via a second gas duct 17, are located in security entrance 4. A second blower 18 arranged in the second gas duct 17 delivers the interior space air over a first toxic gas filter 19 from the second air return duct 15 to the second air feed duct 13. The interior space air drawn in via the second air return duct 15 is purified in the first toxic gas filter 19 and returns as decontaminated air back into the interior space via the second air feed duct 13.

Holding room 5 has a third air feed duct 20 with discharge openings 21, a third air return duct 22 with inlet openings 23 and a third gas duct 24 with a third blower 26 and a second toxic gas filter 25 for delivering the interior space air from the third air return duct 22 to the third air feed duct 20. A breathing air line 27 for breathing masks, shown schematically, extends in the middle of holding room 5. The breathing air line is connected to a breathing air storage unit 29 via an air control panel 28. A supply line 30 extends from air control panel 28 via a sound absorber 31. The third air feed duct 20 is thus supplied with gas via both the third blower 26 and the breathing air storage unit 29, so that residual contaminations are flushed out of the holding room 5 via both the breathing air storage unit and via the air from the breathing air storage unit 29. Excess gas is released from holding room 5 via a spring-loaded pressure relief valve 32. Pressure relief valve 32 is set such that an interior space pressure that prevents toxic gases from entering from the environment will always prevail in holding room 5.

Figure 2:
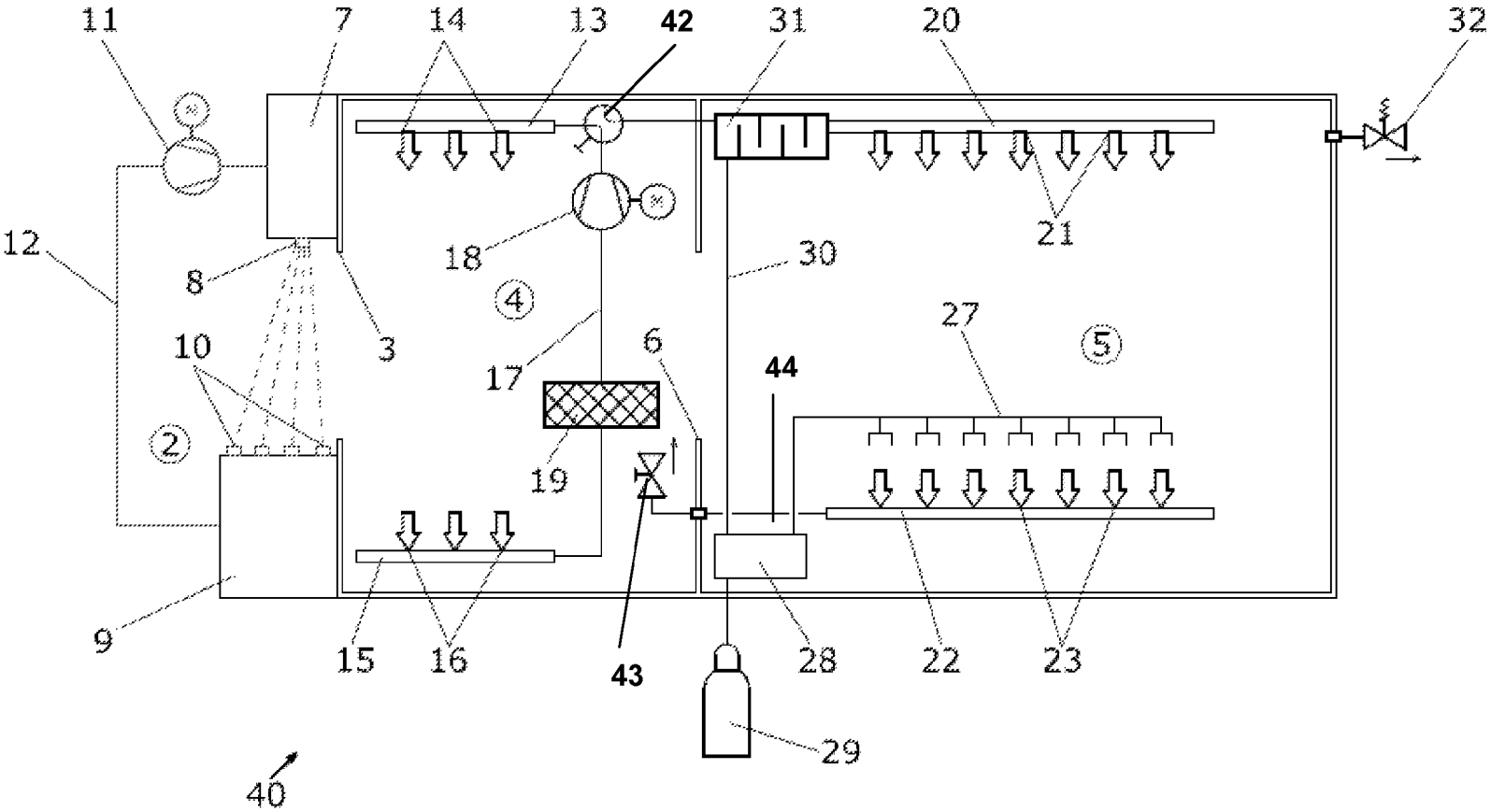
FIG. 2 is a pneumatic circuit diagram of a first alternative to the personal safety system according to FIG. 1.

FIG. 2 illustrates a first alternative personal safety system 40, in which a common toxic gas filter 19 is used to filter the interior space air in the security entrance 4 and in the holding room 5, unlike in the personal safety system 1 according to FIG. 1. Identical components are designated by the same reference numbers as in FIG. 1. To deflect the flushing air between security entrance 4 and holding room 5, a reversing valve 42 is provided in the second gas duct 17 between the second blower 18 and the second air feed duct 13 and the sound absorber 31. In the first switching position of reversing valve 42 as shown in FIG. 2, the second blower 18 delivers the air drawn in via the first toxic gas filter 19 into the second air feed duct 13. In a second switching position of reversing valve 42, the second blower 18 is connected to sound absorber 31, and the air being delivered enters the third air feed duct 20 via sound absorber 31. The third air return duct 22 is connected via a fourth gas duct 44 to a discharge valve 43 designed as a pressure relief valve, which opens into security entrance 4. The first alternative personal safety system 40 is characterized by an especially fast transfer of persons into holding room 5. The persons pass through the security entrance 4 and enter holding room 5. Reversing valve 42 is at first in the first switching position and is then switched over into the second switching position. The air circulation then takes place via sound absorber 31 into the third air feed duct 20 and from the third air return duct 22, the fourth gas duct 44 and the discharge valve 43 into security entrance 4, where the room air is drawn in via the second air return duct 15. Contaminations carried in are reduced to a fixed limit value by flushing with air within holding room 5. A filter unit is rendered superfluous in the first alternative personal safety system 40 compared to the personal safety system 1 according to FIG. 1.

Figure 3:
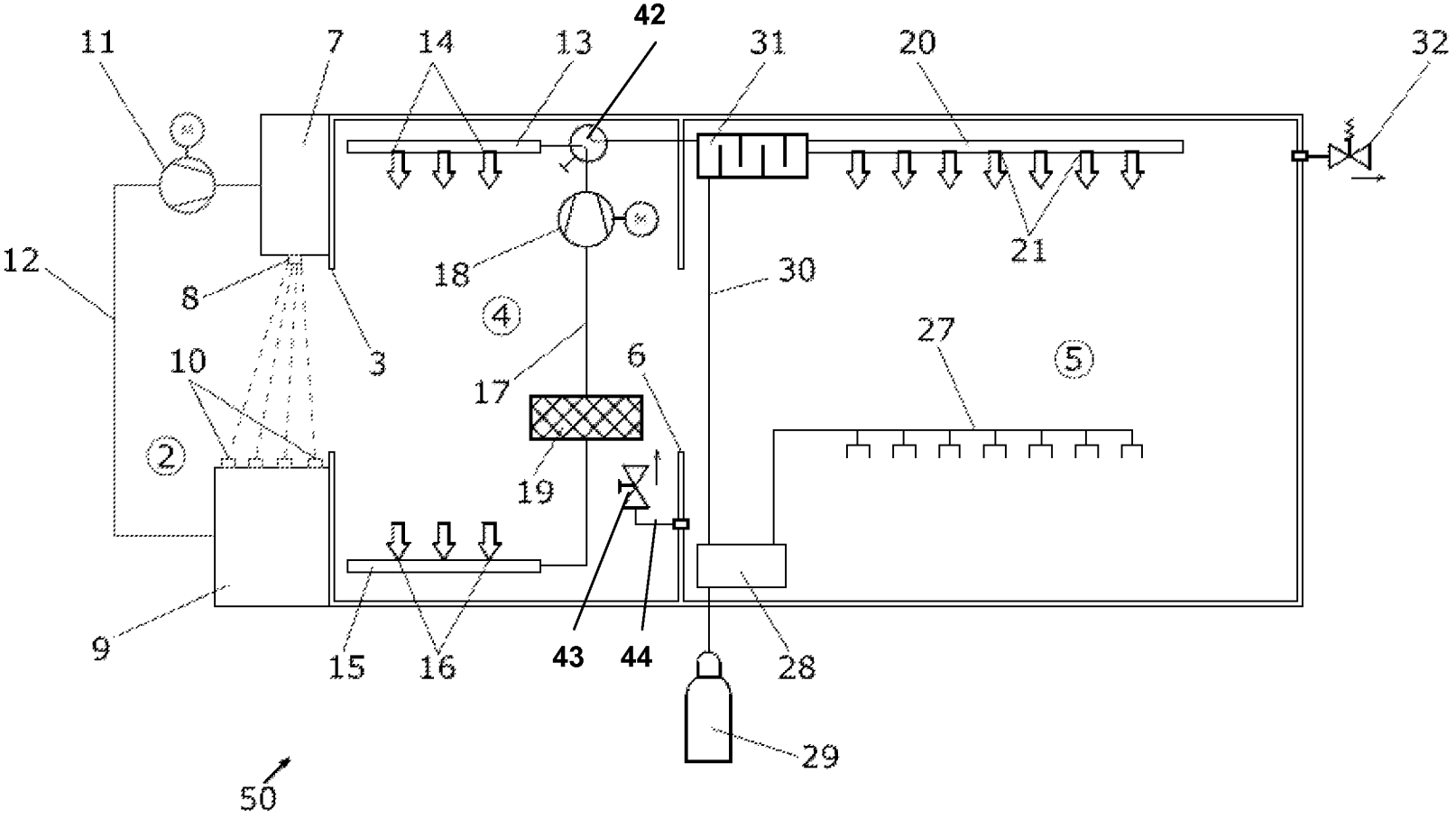
FIG. 3 is a pneumatic circuit diagram of a second alternative to the personal safety system according to FIG. 2.

FIG. 3 shows a second alternative personal safety system 50, in which the air entering the holding room 5 via the third air feed duct 20 is not collected in an air return duct, but is removed directly into the security entrance 4 via the fourth gas duct 44 and discharge valve 43, unlike in the first alternative personal safety system 40 according to FIG. 2. This air routing can be selected if a specific air return routing via the third air return duct 22 is necessary for air purification. The useful area in the holding room 5 also increases as a result, because no air return duct needs to be installed.

While specific embodiments of the invention have been shown and described in detail to illustrate the application of the principles of the invention, it will be understood that the invention may be embodied otherwise without departing from such principles.

APPENDIX

List of Reference Numbers

1 Personal safety system
2 Air curtain device
3 Entrance door
4 Security entrance
6 Passage door
7 First air feed duct
8 Discharge opening
9 First air return duct
10 Inlet opening
11 First blower
12 First gas duct
13 Second air feed duct
14 Discharge opening
15 Second air return duct
16 Inlet opening
17 Second gas duct
18 Second blower
19 First toxic gas filter
20 Third air feed duct
21 Discharge opening
22 Third air return duct
23 Inlet opening
24 Third gas duct
25 Second toxic gas filter
26 Third blower
27 Supply duct
28 Gas distributor
29 Breathing air storage unit
30 Supply line
31 Sound absorber
32 Pressure relief valve
40 First alternative personal safety system
42 Reversing valve
43 Discharge valve
44 Fourth gas duct
50 Second alternative personal safety system

What is claimed is:

1. A personal safety system comprising:

a security entrance with an entrance door, said security entrance enclosing a security entrance interior space;

a holding room connected to said security entrance, said holding room enclosing a holding room interior space;

an air curtain device at said entrance door of said security entrance;

an circulating air system for said security entrance interior space enclosed by said security entrance and for said holding room interior space, said circulating air system comprising at least one air delivery unit, a holding room feed duct, a holding room air return duct, a security entrance air feed duct, a security entrance air return duct and a toxic gas filter, said holding room feed duct and said holding room air return duct being arranged in said holding room, said security entrance air feed duct and said security entrance air return duct being arranged in said security entrance, said toxic gas filter being arranged in said security entrance, said toxic gas filter being connected to one or more of said holding room feed duct, said holding room air return duct, said security entrance air feed duct and said security entrance air return duct;

an air flushing device comprising air storage units for said holding room; and a gas supply duct for respirator products.

2. The personal safety system in accordance with claim 1, wherein said air curtain device comprises an air curtain device air feed duct, an air curtain device air return duct and an air curtain device blower.

3. The personal safety system in accordance with claim 2, wherein said security entrance air feed duct is arranged adjacent to said air curtain device air feed duct, said security entrance air return duct being arranged adjacent to said air curtain device air return duct.

4. The personal safety system in accordance with claim 1, wherein said circulating air system is a common circulating air system for said security entrance and said holding room, said common circulating air system having said security entrance air feed duct and said security entrance air return duct in said security entrance space, a blower with said toxic gas filter between said security entrance air return duct and said security entrance air feed duct and a reversing valve on a discharge side of said blower, wherein said reversing valve establishes a security entrance gas path in a first switching position, said security entrance gas path comprising said blower, said security entrance air feed duct, said security entrance air return duct and said toxic gas filter, wherein air is delivered to said security entrance via said security entrance air feed duct and said security entrance air return duct receives fluid from said security entrance interior space such that said fluid is filtered via said toxic gas filter to provide filtered air with said reversing valve in said first switching position, wherein said filtered air is delivered to said security entrance via said blower with said reversing valve in said first switching position, said reversing valve establishing a holding room gas path in a second switching position, said holding room gas path comprising said blower, said holding room air feed duct, said holding room air return duct and said toxic gas filter, wherein air is delivered to said holding room interior space via at least said security entrance return duct and said holding room air feed duct with said reversing valve in said second switching position, said holding room air return duct receiving holding room fluid from said holding room interior space such that said holding room fluid is filtered by said toxic gas filter to provide filtered holding room fluid with said reversing valve in said second switching position, wherein said holding room air feed duct receives said filtered holding room fluid via said blower with said reversing valve in said second switching position.

5. The personal safety system in accordance with claim 4, wherein said air storage units of said air flushing device are connected to said another air feed duct in said holding room.

6. The personal safety system in accordance with claim 1, wherein said air flushing device and/or said circulating air system are designed for a flushing flow rate of at least 600 $m^3$/hr.

7. A personal safety system comprising:

an enclosed space with a holding room, an entrance door, a security entrance space between said holding room and said entrance door, a holding room wall to delimit said holding room and a passage door providing a passage through said holding room wall to provide access between said holding room and said security entrance space;

an air curtain device at said entrance door;

an circulating air system for said enclosed space, said circulating air system comprising at least one air delivery unit and a toxic gas filter, wherein said circulating air system is a common circulating air system for said security entrance space and said holding room, said common circulating air system having an air feed duct and an air return duct in said security entrance space, a blower with said toxic gas filter between said air return duct and said air feed duct and a reversing valve on a discharge side of said blower, wherein said reversing valve establishes a gas path to said air feed duct in a first switching position and establishes a gas path to another air feed duct in said holding room in a second switching position;

an air flushing device comprising air storage units for supplying air in said holding room; and a gas supply duct with a plurality of respirator products provided in said holding room.

8. The personal safety system in accordance with claim 7, wherein said air curtain device comprises an air curtain device air feed duct, an air curtain air return duct and an air curtain blower, wherein said security entrance air feed duct is arranged adjacent to said air curtain device air feed duct, said security entrance air return duct being arranged adjacent to said air curtain device air return duct.

9. The personal safety system in accordance with claim 8, wherein said reversing valve establishes a security entrance gas path in a first switching position, said security entrance gas path comprising said blower, said security entrance air feed duct, said security entrance air return duct and said toxic gas filter, wherein air is delivered to said security entrance via said security entrance air feed duct and said security entrance air return duct receives fluid from said security entrance interior space such that said fluid is filtered via said toxic gas filter to provide filtered air with said reversing valve in said first switching position, wherein said filtered air is delivered to said security entrance via said blower with said reversing valve in said first switching position, said reversing valve establishing a holding room gas path in a second switching position, said holding room gas path comprising said blower, said holding room air feed duct, said holding room air return duct and said toxic gas filter, wherein air is delivered to said holding room interior space via said holding room air feed duct and said holding room air return duct receives holding room fluid from said holding room interior space such that said holding room fluid is filtered by said toxic gas filter to provide filtered holding room fluid with said reversing valve in said second switching position, wherein said holding room air feed duct receives said filtered holding room fluid via said blower with said reversing valve in said second switching position.

10. The personal safety system in accordance with claim 7, wherein said air storage units of said air flushing device are connected to said another air feed duct in said holding room.

11. The personal safety system in accordance with claim 7, wherein said air flushing device and/or said circulating air system are designed for a flow rate of at least 600 $m^3$/hr.

12. A personal safety system comprising:

a security entrance with an entrance door, said security entrance comprising a security entrance interior space;

a holding room connected to said security entrance, said holding room comprising a holding room interior space;

an air curtain device at said entrance door of said security entrance;

an circulating air system for said security entrance interior space and said holding room interior space, said circulating air system comprising at least one air delivery unit, a holding room air feed duct, a security entrance air feed duct, a security entrance air return duct and a toxic gas filter, said holding room feed duct being arranged in said holding room, said security entrance air feed duct and said security entrance air return duct being arranged in said security entrance, said toxic gas filter being arranged in said security entrance, said circulating air system comprising a reversing valve, said reversing valve comprising a first switching position and a second switching position, said security entrance air feed duct being in fluid communication with said security entrance interior space, said security entrance air return duct, said toxic gas filter and said blower with said reversing valve in said first switching position, said holding room air feed duct being in fluid communication with said security entrance interior space with said reversing valve in said second switching position;

an air flushing device comprising air storage units for said holding room; and a gas supply duct for respirator products.

13. The personal safety system in accordance with claim 12, wherein said circulating system further comprises a holding room air return duct, said holding room air return duct being arranged in said holding room, said holding room air feed duct being in fluid communication with said holding room air return duct, said toxic gas filter, said blower and said holding room air return duct with said reversing valve in said second switching position.

14. The personal safety system in accordance with claim 13, wherein said holding room interior space is in fluid communication with said security entrance interior space with said reversing valve in said second switching position.

15. The personal safety system in accordance with claim 13, wherein an inlet of said circulation system is located in said security entrance interior space and an outlet of said circulation system is located in said security entrance with said reversing valve in said first switching position and with said reversing valve in said second switching position.

16. The personal safety system in accordance with claim 13, wherein said holding room air feed duct is not in fluid communication with said security entrance air feed duct, said toxic gas filter and said security entrance air return duct with said reversing valve in said first switching position.

17. The personal safety system in accordance with claim 13, wherein air is delivered exclusively to said security entrance interior space with said reversing valve in said first switching position.

18. The personal safety system in accordance with claim 13, wherein said air curtain device comprises an air curtain device air feed duct, an air curtain device air return duct and an air curtain device blower, said security entrance air feed duct being arranged adjacent to said air curtain device air feed duct, said security entrance air return duct being arranged adjacent to said air curtain device air return duct.

* * * * *